US010343798B2

(12) United States Patent
Jaconelli

(10) Patent No.: US 10,343,798 B2
(45) Date of Patent: Jul. 9, 2019

(54) METHOD AND MACHINE FOR THE ROBOT WRAPPING OF A PALLETIZED LOAD WITH A COVER MADE OF FLEXIBLE PLASTICS MATERIAL

(75) Inventor: Jean-Christophe Jaconelli, Tresserve (FR)

(73) Assignee: THIMON, Mery (FR)

( * ) Notice: Subject to any disclaimer, the term of this patent is extended or adjusted under 35 U.S.C. 154(b) by 1236 days.

(21) Appl. No.: 13/988,701

(22) PCT Filed: Nov. 22, 2011

(86) PCT No.: PCT/FR2011/000612

§ 371 (c)(1),
(2), (4) Date: May 21, 2013

(87) PCT Pub. No.: WO2012/069712

PCT Pub. Date: May 31, 2012

(65) Prior Publication Data

US 2013/0232919 A1 Sep. 12, 2013

(30) Foreign Application Priority Data

Nov. 22, 2010 (FR) ..... 10 04538

(51) Int. Cl.
*B65B 11/00* (2006.01)
*B65B 9/13* (2006.01)
*B65B 57/00* (2006.01)

(52) U.S. Cl.
CPC ..... *B65B 11/00* (2013.01); *B65B 9/135* (2013.01); *B65B 57/00* (2013.01)

(58) Field of Classification Search
CPC ..... B65B 9/135; B65B 57/00; B65B 11/00; B65B 9/13; B65B 11/585; B65B 43/14; B65B 43/26; B65B 43/44; B65B 57/10; B65B 57/12
USPC ..... 53/397, 459, 582, 585, 567, 576, 64, 66, 53/74
See application file for complete search history.

(56) References Cited

U.S. PATENT DOCUMENTS 3,897,674 A 8/1975 Higgins
4,744,039 A * 5/1988 Suzuki ..... B25J 9/1692 700/193
5,761,881 A * 6/1998 Wall ..... B65B 25/148 53/136.2

(Continued)

FOREIGN PATENT DOCUMENTS

EP 0 395 919 A1 11/1990
EP 1 060 988 A1 12/2000

(Continued)

*Primary Examiner* — Thanh K Truong
*Assistant Examiner* — Thomas M Wittenschlaeger
(74) *Attorney, Agent, or Firm* — Oliff PLC

(57) ABSTRACT

A wrapping machine has a transfer and accumulation device including an accumulator element on which a part of the sleeve is wound, and a mechanism for performing spreading of the open end of the sleeve after transfer to the covering station. According to the invention, a programmable control device determines the position and/or the inclination angle of the feed axis of the load by synchronizing the positioning control of the transfer device with position data of the load. This results in positioning of the transfer device according to the spatial position of the load to be packaged.

20 Claims, 13 Drawing Sheets

(56) References Cited

U.S. PATENT DOCUMENTS

| | | | | |
|---|---|---|---|---|
| 6,845,600 | B2 * | 1/2005 | Hannen | C04B 38/00 53/441 |
| 2008/0236108 | A1 * | 10/2008 | Parmley | B65B 11/54 53/504 |
| 2010/0162660 | A1 | 7/2010 | Jaconelli et al. | |

FOREIGN PATENT DOCUMENTS

| | | | |
|---|---|---|---|
| EP | 1 574 433 | B1 | 8/2007 |
| FR | 2 478 578 | A1 | 9/1981 |
| FR | 2 893 005 | A1 | 5/2007 |

* cited by examiner

METHOD AND MACHINE FOR THE ROBOT WRAPPING OF A PALLETIZED LOAD WITH A COVER MADE OF FLEXIBLE PLASTICS MATERIAL

BACKGROUND OF THE INVENTION

The invention relates to a method and device for forming and depositing a packaging cover on a palletized load, said cover being prepared from a sleeve made from flexible plastic material wound on at least one storage reel, a method consisting in:

- storing a predefined length of sleeve on a transfer and accumulation device to constitute a cover closed at one end,
- taking up the opposite open end, and moving the cover down around the load to be packaged, keeping the cover spread open via its four corners.

STATE OF THE ART

Most known machines possess a sleeve opening device placed above the load to be packaged, during the covering operation, the load being input according to an automated sequential cycle into the machine by means of a roller or chain-driven conveyor and positioned with precision underneath the sleeve opening device.

In these machines, a sleeve storage reel is placed not far from the ground, and its axis extends parallel to or at another angle with the transfer conveyor of the load to be packaged.

In the version where the reel is parallel to the conveyor, the unwound sleeve moves up vertically along the machine to position its open end above the load to be packaged.

In the version where the axis of the reel is positioned at another angle not parallel to the conveyor, the unwound sleeve passes via an angle transmission device before or after moving up vertically along the machine to position its opening above the load to be packaged.

In both these cases, the transverse feed axis of the sleeve coincides with the transverse axis of the transfer and accumulation device, and the transverse axis of the load, and is fixed independently from the loads.

The documents EP1060988 and EP1574433B1 each describe a device for performing overpackaging of a palletized load by means of a cover prepared from a gusseted sleeve wound flat on a storage reel. A gripping robot comprises an accumulation system on which a part of the sleeve is accumulated, a transfer arm for transferring the roller to the covering station, and a mechanism for spreading the cover open during the downward movement around the load. The sleeve, previously heat-sealed in the transverse direction, is kept in the vertical position with the gussets forced to the open position by positioning means. The arm of the robot is animated with at least one horizontal translational movement towards the covering station which is executed perpendicularly to this covering station.

The document EP-A-0395919 relates to a machine for packaging a palletized load by means of a heat-shrink film, comprising four vertical bars equipped with gripping members of the film able to move up and down in the frame. It further comprises an annular retraction furnace, a pair of horizontal cross-bars and two carriages able to move horizontally along the cross-bars. The bars move towards one another when the carriage moves towards the distribution section, and move away from one another when the carriage is above the load to be packaged. This mechanism also performs pallet covering. The movement of the carriage also takes place perpendicularly to the covering station.

In known systems of this type, the transverse axis of the covering station is compulsorily the same as the feed axis of the sleeve coming from the storage reel. This sometimes results in location constraints of the sleeve storage reel with respect to the position constraints of the feed conveyor of the load to be packaged.

In addition, the longitudinal axis of the load to be packaged is compulsorily fixed and corresponds by construction to the longitudinal axis of the transfer and accumulation device. This means that the load to be packaged in the covering station has to be positioned with precision along the two axes. In most cases, a transverse and/or longitudinal load centring device is used in the covering station or up-line from the latter.

OBJECT OF THE INVENTION

A first object of the invention consists in improving the method for performing preparation and deposition of a cover on a load to be packaged, to limit the location constraints of the sleeve storage reel with respect to the constraints on the position of the feed conveyor of the load to be packaged.

The packaging method according to the invention is characterized by the following intermediate steps:

- determining the position of the transverse mid-axis of the load to be packaged with respect to the feed axis of the sleeve,
- moving the transfer and accumulation device of the cover above the load to be packaged, synchronizing the positioning control of said device with the position data of the load to be packaged.

The positioning of the load can be either measured to define said position of the transverse mid-axis or programmed in advance. The robot is thus positioned according to a specific measurement or parameter setting, and the load can be located anywhere on the conveyor.

During the positioning step of the load to be packaged, the position of the longitudinal axis of the load to be packaged is measured and/or programmed to enable longitudinal positioning of the transfer and accumulation device of the cover. This results in the possibility of eliminating the longitudinal centring device used in the prior art.

It is also possible to measure and/or program the position of the two transverse and longitudinal axes of the top plane of the load to be packaged. The transfer and accumulation device of the cover can then be positioned according to these axes. This results in the possibility of using sleeves having a perimeter adjusted to the perimeter of the load to be packaged. In this version in fact, the perimeter of a sleeve is calculated according to a functional clearance necessary between the perimeter of the load to be packaged and that of the cover. In most cases, the loads to be packaged present a deformation which generally results from an offset of the top plane of the load with respect to the bottom plane. In order to preserve the film from the frictions on the load to be packaged, the perimeter of the sleeve is calculated according to the largest perimeter of the load (union of the projection on the ground of the different planes of the load to be packaged). The positioning of the transfer and accumulation device of the cover according to the axes of the top plane of the load enables the functional clearance to be balanced as best as possible during downward movement of the covering mechanism around the load. It also makes it possible to work with a sleeve having a perimeter that is adjusted to that of the load to be packaged thereby enabling the quantity of cover used to be reduced.

During the step in which the cover is taken up and spread open, the covering mechanism positions the take-up and spreading elements according to the position of the transfer and accumulation device of the cover.

During the step of moving downwards around the load, the covering mechanism controls the position of its take-up and spreading elements according to the position of the load to be packaged.

The load to be packaged may not be stopped on the covering area. Measurement of the position of the transverse axis of the load is performed while it is transported, so that the covering mechanism controls the position of its take-up and spreading elements of the cover so that they also follow the position of the load continually.

It is also possible to measure and/or program the angular position of the two transverse and longitudinal axes of the load to be packaged. During the transfer and take-up step of the cover by the covering mechanism, a rotation takes place with respect to a vertical axis by a suitable angle in order to ensure a good position with respect to the load.

This results in the possibility of positioning the cover in the best direction according to the load to be packaged, but also of adjusting to a feed axis of the load that is not perpendicular to the feed axis of the sleeve.

During the transfer and take-up step of the cover by the covering mechanism, the device can perform a rotation through a suitable angle with respect to a vertical axis in order to ensure correct insertion of the film on the take-up and spreading fingers. This results in the possibility of using a film suited to the load to be packaged limiting the impact of the dimensions of the take-up and spreading fingers.

During the transfer and take-up step of the cover by the covering mechanism, the device performs a combination of movements and rotations through a suitable angle with respect to a horizontal axis in order to ensure correct insertion of the film on the take-up and spreading fingers. This results in the possibility of using a film suited to the load to be packaged limiting the impact of the dimensions of the take-up and spreading fingers.

The cover opening and throughput device is positioned on a vertical plane at a height calculated according to several parameters, in particular the height of the load, in order to ensure correct guiding of the film:

- during the step of downward movement of the covering mechanism around the load for a first version. This results in better control of depositing of the cover in order to eliminate friction of the cover on the load to be packaged;
- during the pleating step of the cover on the fingers for another version. This results in better control of the friction on the pleating fingers.

A second object of the invention consists in providing a machine for forming and depositing a packaging cover on a palletized load, limiting the location constraints of the storage reel of the sleeve with respect to the positional constraints of the feed conveyor of the load to be packaged and being able to indifferently use a sleeve with or without a gusset and made from plastic material or not.

The machine comprises a transfer and accumulation device comprising an accumulator element on which a part of the sleeve is wound, and a mechanism for spreading the open end of the sleeve after transfer to the covering station. According to the invention, a control and/or measuring device of the position and the inclination angle of the feed axis of the load, by synchronizing control of positioning of the transfer device with the load position measurement data, enables positioning of said transfer device to be performed, in space, according to the position of the load to be packaged.

Other Features can be Used in Combination:

The transfer device can be configured to enable a new gusseted sleeve to be placed on the positioning means using a first reel whereas it continues to operate using the second reel.

The reels can be located in perfectly free manner as far as position is concerned, but also along a parallel, perpendicular or indifferent axis with respect to the conveyor.

The gripping means can be positioned at a defined height level and in a space dedicated to maintenance enabling a good accessibility for maintenance operations.

During the covering phase, the gripping means can prepare a new cover and anticipate feeding of other covering frames located in the accessible enclosure.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
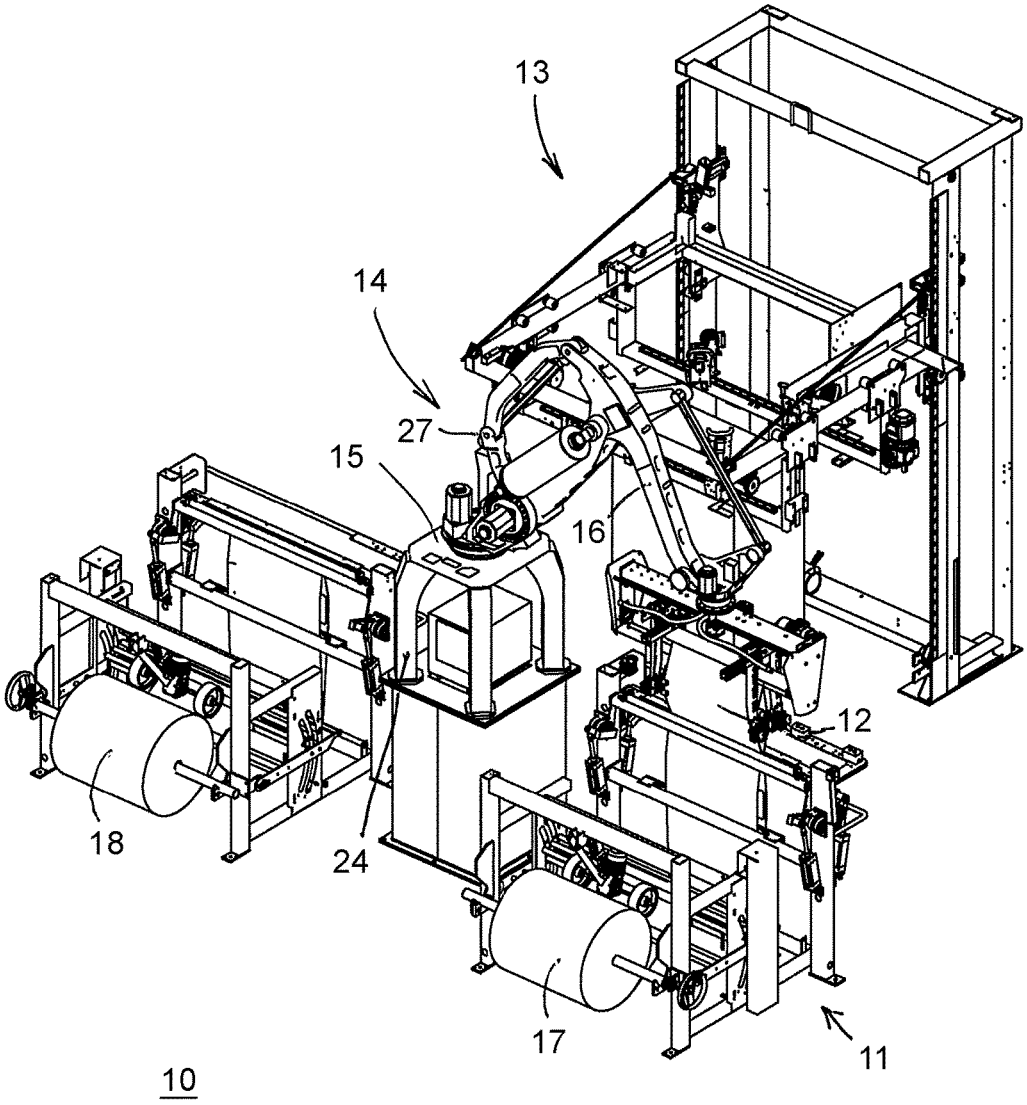
FIGS. 1 to 4 describe the packaging machine according to the invention with different operating cycles.

In the figures, a packaging machine 10 of a palletized load CH is composed of a first preparation and forming station 11 of a cover 12 from a film made from flexible plastic material, of a second covering station 13 for depositing the cover 12 on the load CH, and of a transfer device 14 between the two stations 11, 13.

A conveyor 32 feeds loads CH to covering station 13 at a predefined rate.

Control of the transfer device 14 is performed by a robot 15 with a multidirectional actuating arm 16 of 4-axis or 5-axis type, for example a FANUC (registered trademark) robot, controlled by a control circuit with a programmable processor.

Packaging cover 12 is formed by a tubular sleeve formed by a film made from flexible plastic material, for example polyethylene or any other heat-shrink or stretchable flexible plastic material. The plastic sleeve comprises gussets in the form of a double V, and is folded flat after winding around one or two storage reels 17, 18 in first station 11. The sleeve is unwound from one of the reels 17 passing via rollers 19, and is kept in the vertical position in first station 11, with the gussets forced to the stretched position.

The gusseted film can also be replaced by a simple tubular sleeve without gussets, also folded flat on reels 17, 18.

In the two versions of packaging machines with a heat-shrink or cling film cover, the means of the first preparation station 11 are identical, only the fingers of the depositing arm being changed. In the case of a heat-shrink film, the depositing arm is provided with forming and pinching fingers. In the case of a cling film, the depositing arm comprises pleating and spreading fingers associated with motor-driven rollers to perform accordion pleating of the cover on the bottom part of the fingers.

A transfer and accumulation device DTA formed by an accumulator element 20 and a stretching mechanism 21 with four rocker arms 22 is fitted rotating on the actuating arm 16 of robot 15. The accumulator element 20 comprises for example a motor-driven rotary roller 31 on which a part of the sleeve is wound, which is secured by a securing grip integrated in roller 31. The four rocker arms 22 of stretching mechanism 21 are equipped with grips 23 to guide and seize cover 12. The sleeve is welded transversely to form a heat-welded joint, and the accumulated element 20 is stored over a predefined length of sleeve to form cover 12.

FIGS. 1 to 4 illustrated several operating cycles when preparation, transfer of cover 12, and covering on load CH are performed. These figures concern for example a packaging machine with a cling film sleeve.

In FIG. 1, first preparation station 11 comprises two storage reels 17, 18, and robot 15 is placed on a support 24 between the two reels 17, 18 and facing second covering station 13. Actuating arm 16 of robot 15 is fitted with 360° rotation around a vertical axis 25 on a rotary base 26 of support 24. Actuating arm 16 can also swivel around a horizontal axis 27 to allow upward and downward movements. Multidirectional movement of actuating arm 16 is thus possible above the two stations 11, 13.

Figure 2:
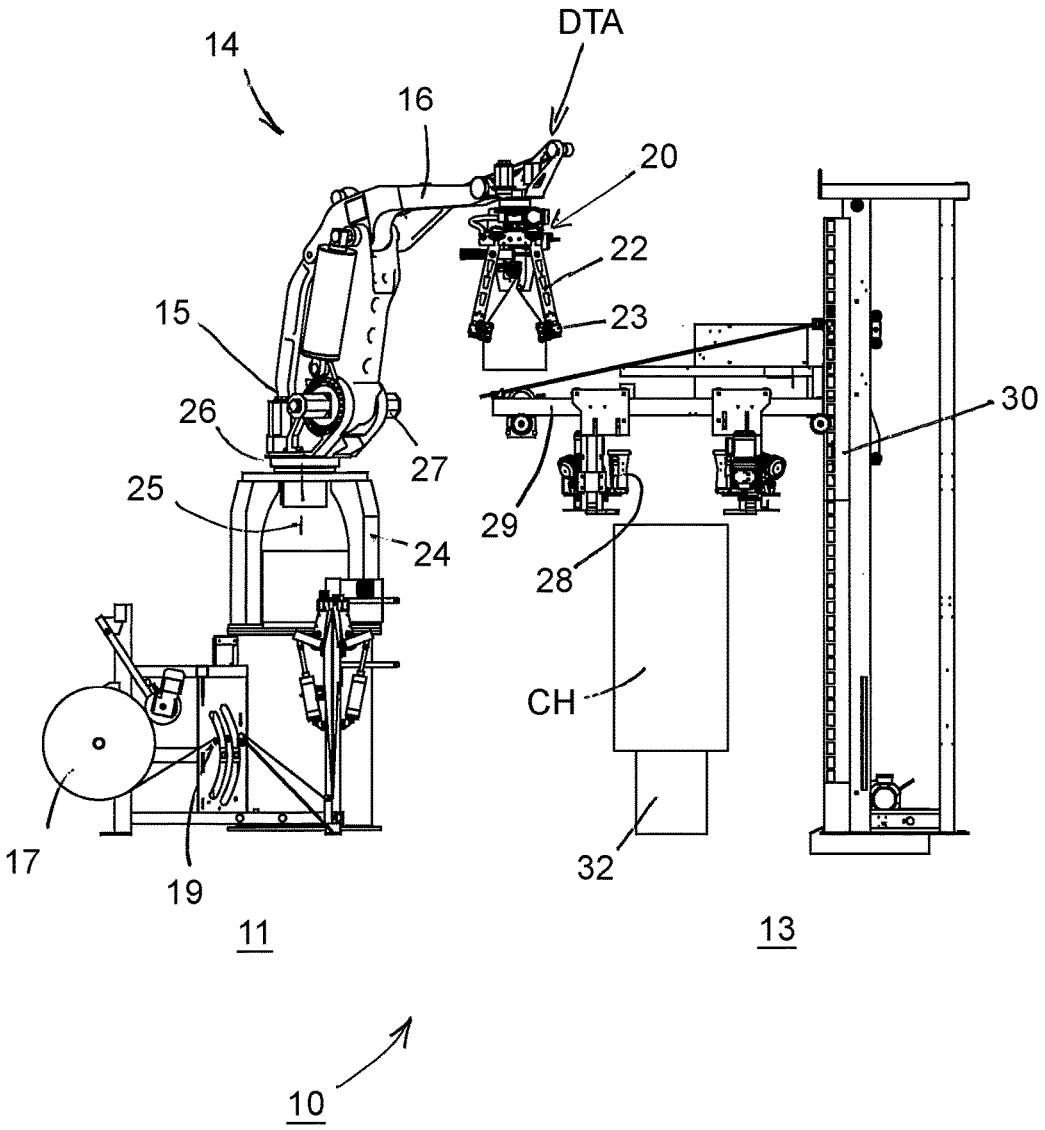

FIG. 2 illustrates transfer of cover 12 wound on accumulator element 20 to second covering station 13. The four rocker arms 22 are actuated to the separated position to cause opening of the bottom free end of cover 12. Fingers 28 can separate horizontally along depositing arm 29 so as to place themselves underneath grips 23 of rocker arms 22. Depositing arm 29 is movable in the upward and downward direction by means of a vertical translation control mechanism 30.

Figure 3:
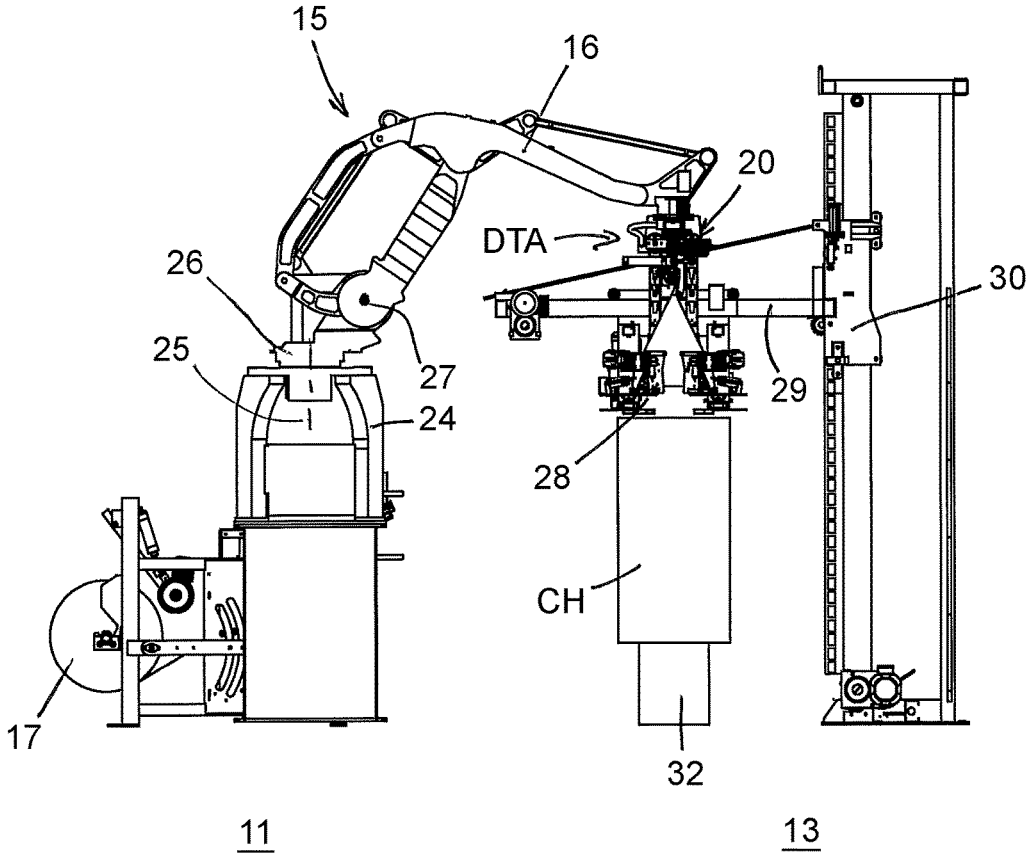

In FIG. 3, the end of cover 12 is taken up in second covering station 13 by fingers 28 of depositing arm 29. The latter is now ready to start its downward movement to progressively envelop load CH with cover 12.

Figure 4:
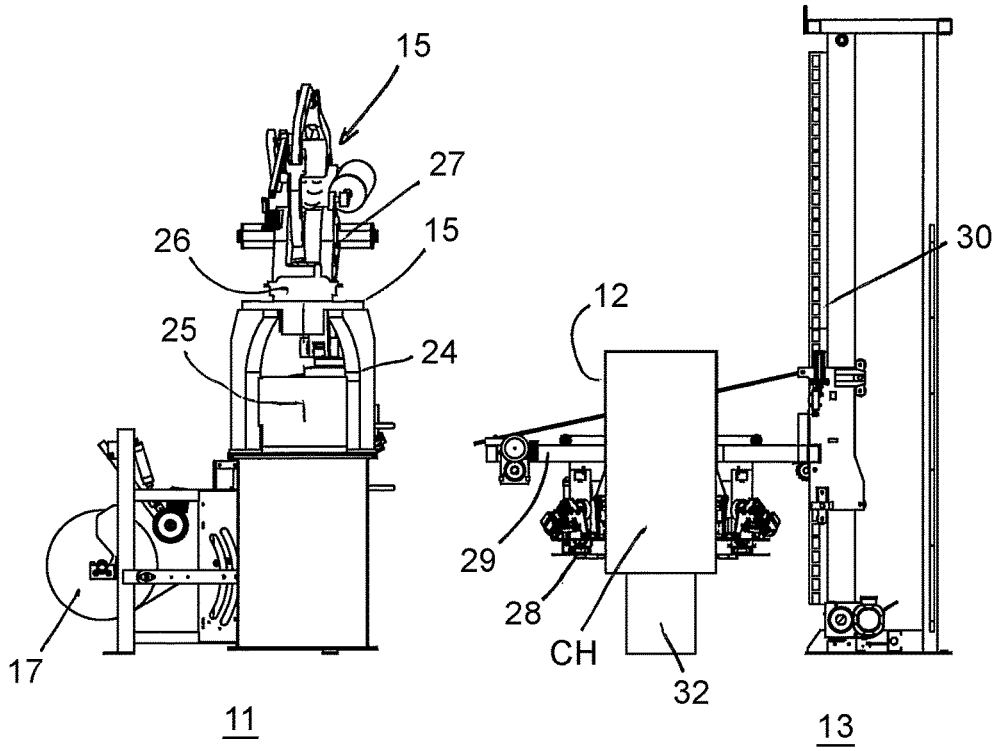

FIG. 4 shows the end of the covering operation, load CH being totally wrapped by cover 12. Depositing arm 29 is located in the down position, and robot 15 has moved accumulator element 20 to first preparation station to prepare a new cover.

Figure 5:
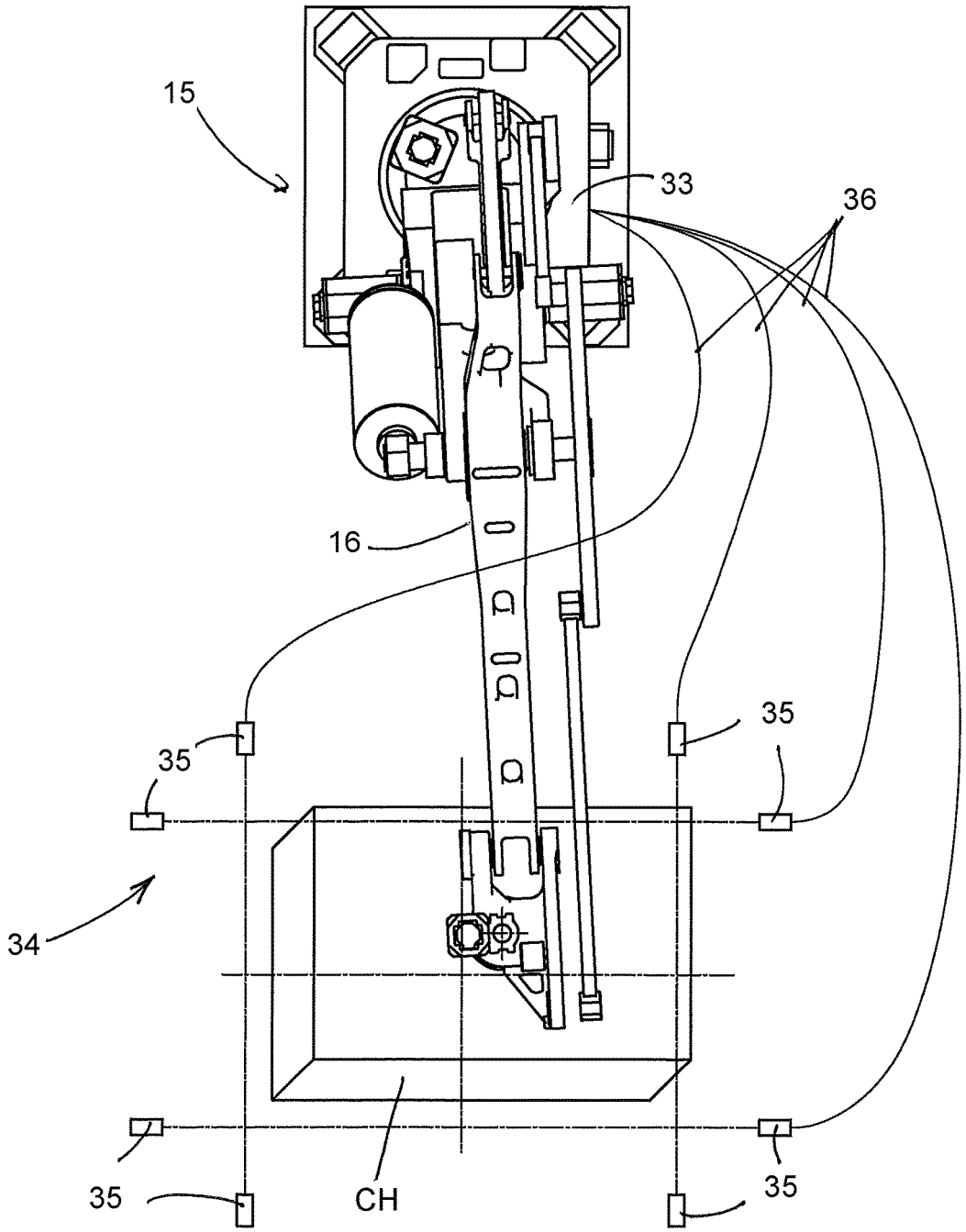
FIG. 5 represents a plane view of the robot and of the load position control system.

In FIG. 5, load CH to be packaged is transported by the conveyor to the covering area. A control system 34 measures the position of load CH when it is stopped. Control system 34 is provided with several optoelectronic sensors 35 arranged according to a certain network layout covering a surface above that of the top of load CH. The different sensors 35 are electrically connected by connecting wires 36 to control circuit 33 of robot 15.

According to a variant, positioning of load CH can be programmed in advance after certain parameters have been stored in the control circuit. The load stops in a predefined position and the robot comes and places itself in a programmed position, without any previous measurement being required.

Figure 6:
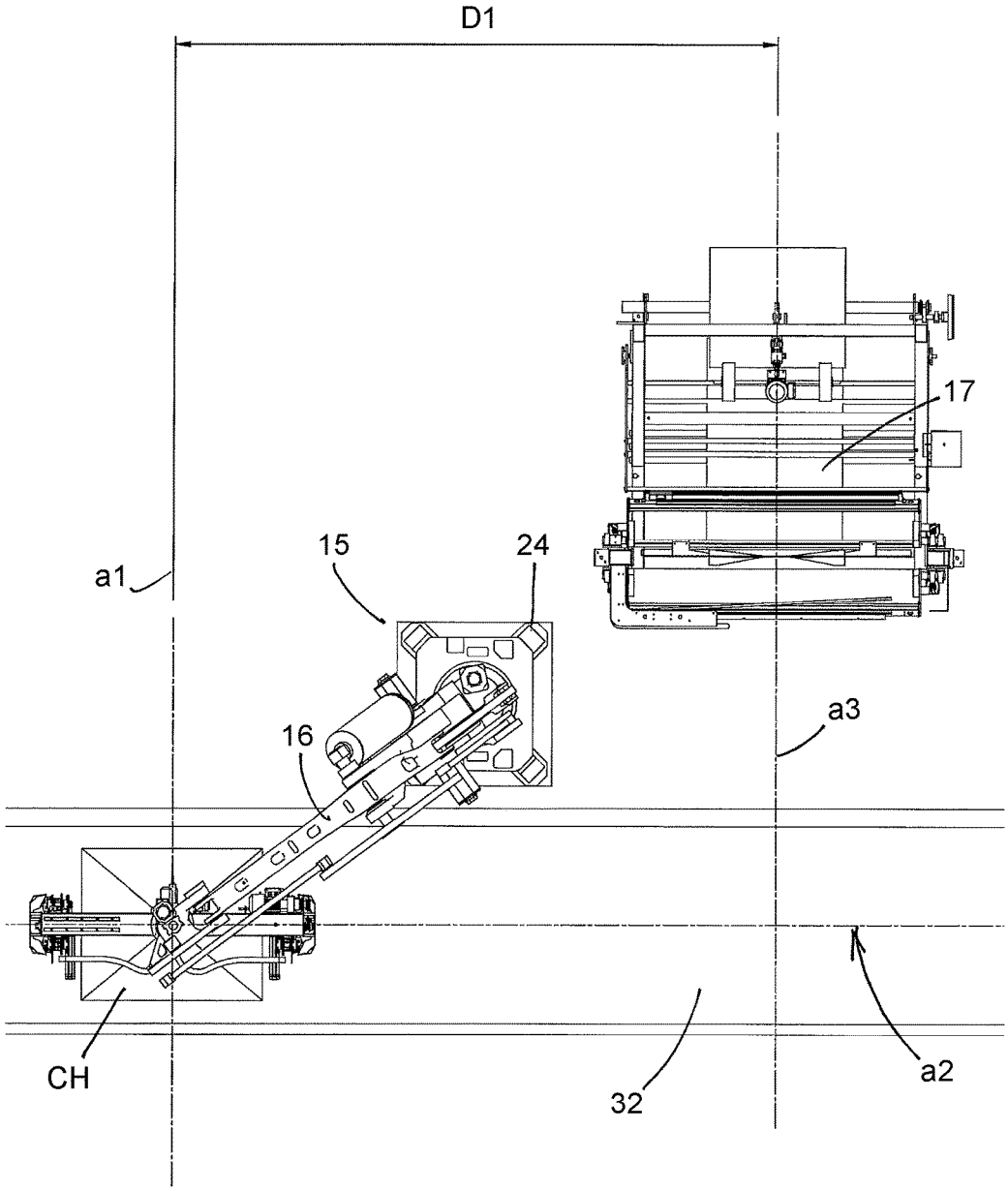
FIGS. 6 to 9 are plane views of the machine with different sleeve feed configurations with respect to the conveyor.

In FIG. 6, it can be noted that the transverse mid-axis a1 of load CH is perpendicular to the longitudinal axis a2 of conveyor 32, and is separated by a distance D1 from the feed access a3 of the sleeve coming from reel 17. The latter is placed in parallel manner to the direction of movement of conveyor 32. In this case, sensors 35 measure the position of the transverse mid-axis a1 of the load to be packaged with respect to the feed axis a2 of the sleeve. Control circuit 33 of robot 15 causes movement of the transfer and accumulation device DTA of the cover to a position above the load CH, synchronizing control of positioning of said device with the measurement data of the position of the load to be packaged.

Figure 7:
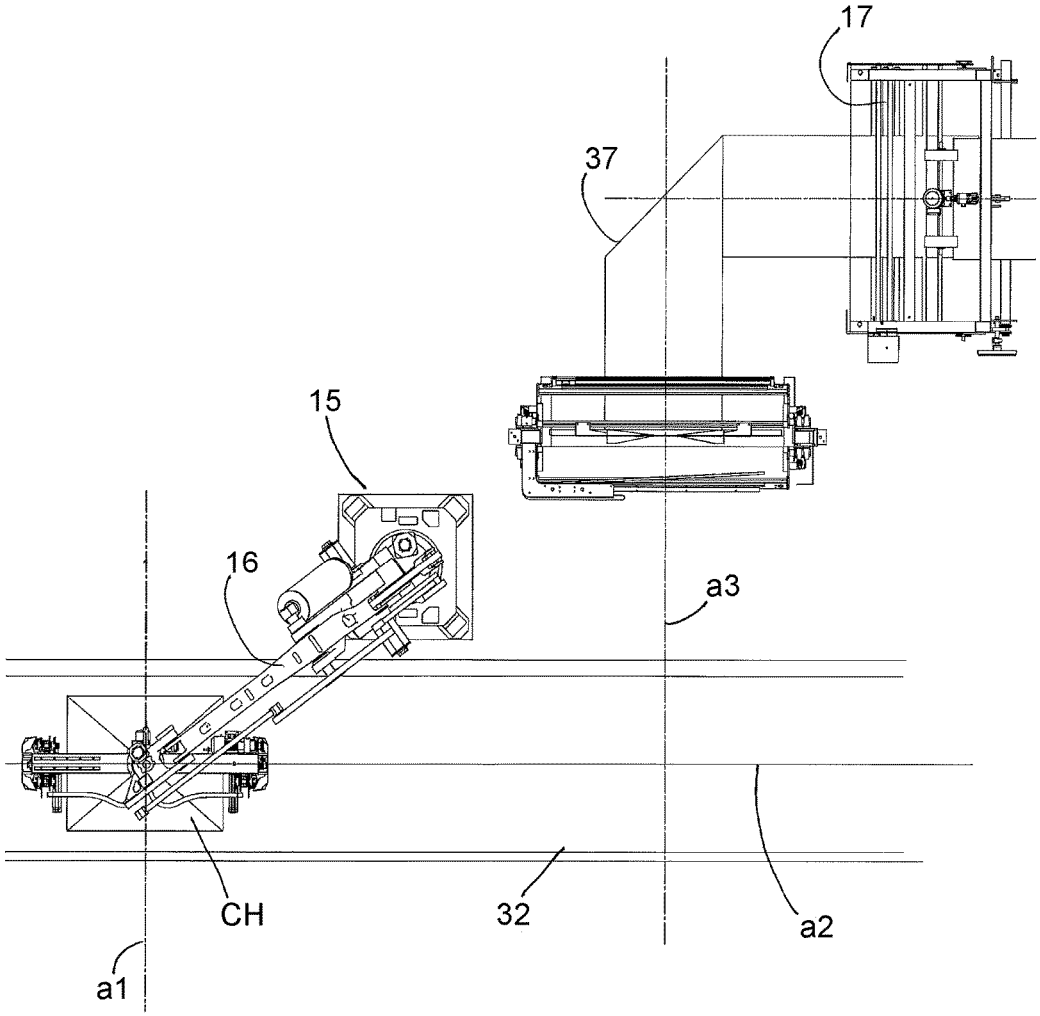

In FIG. 7, reel 17 is moved through 90° extending in parallel manner to conveyor 32. An angle transmission 37 redirects the sleeve to preparation station 38, and the direction of the feed axis a3 of the sleeve is identical to FIG. 6.

Figure 8:
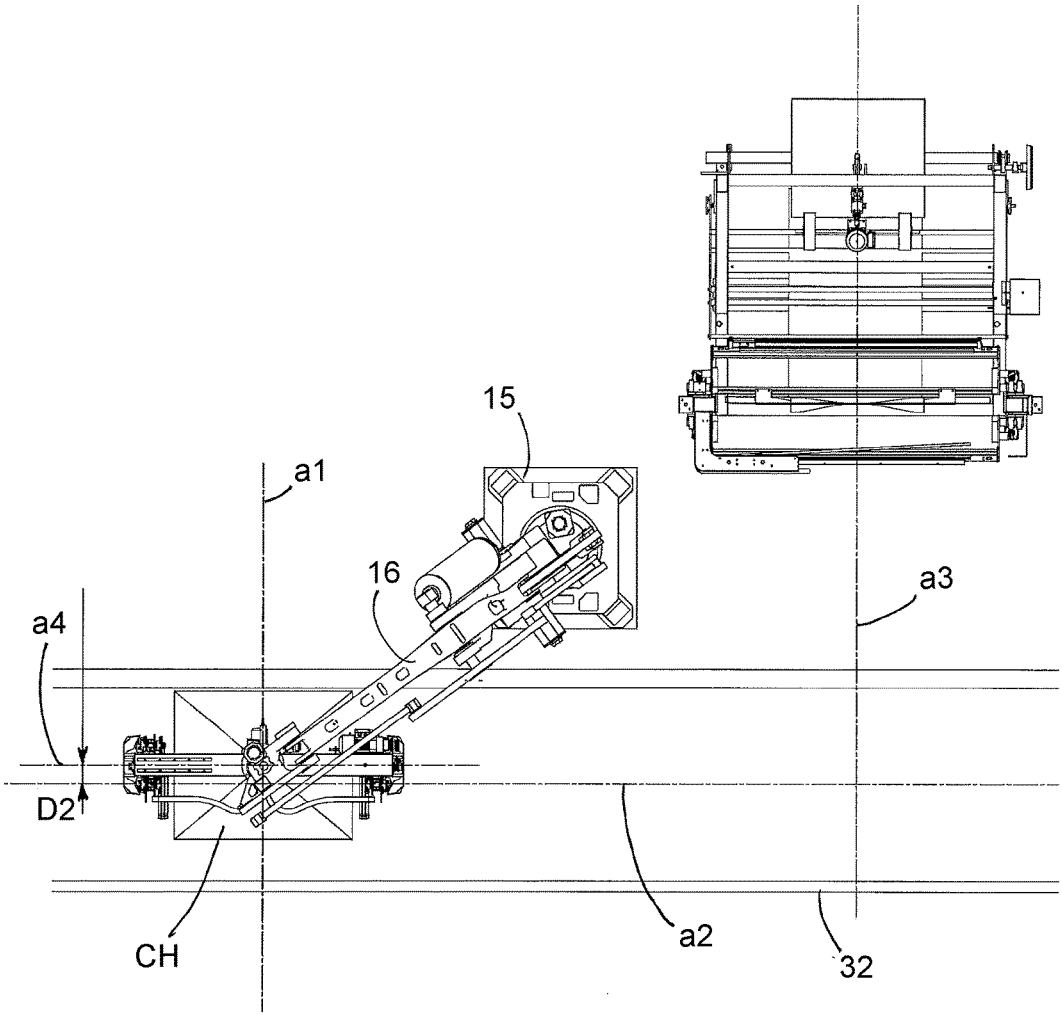

In FIG. 8, the longitudinal mid-axis a4 of load CH is different from the longitudinal axis a2 of conveyor 32. Control system 34 measures the position of longitudinal mid-axis a4 of the load CH to be packaged to enable longitudinal positioning of the transfer and accumulation device DTA of cover 12. This results in the possibility of eliminating the longitudinal centring device used in the prior art.

Figure 9:
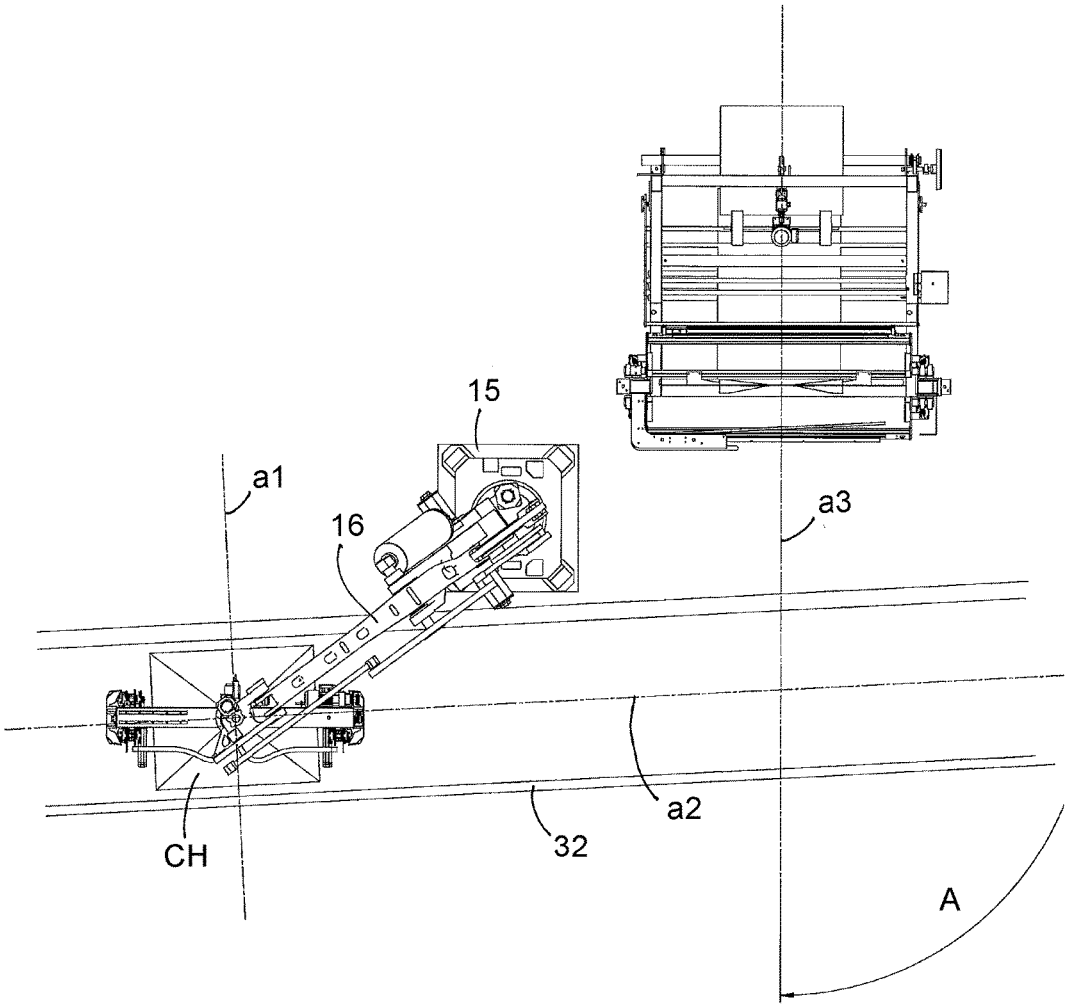
Figure 10:
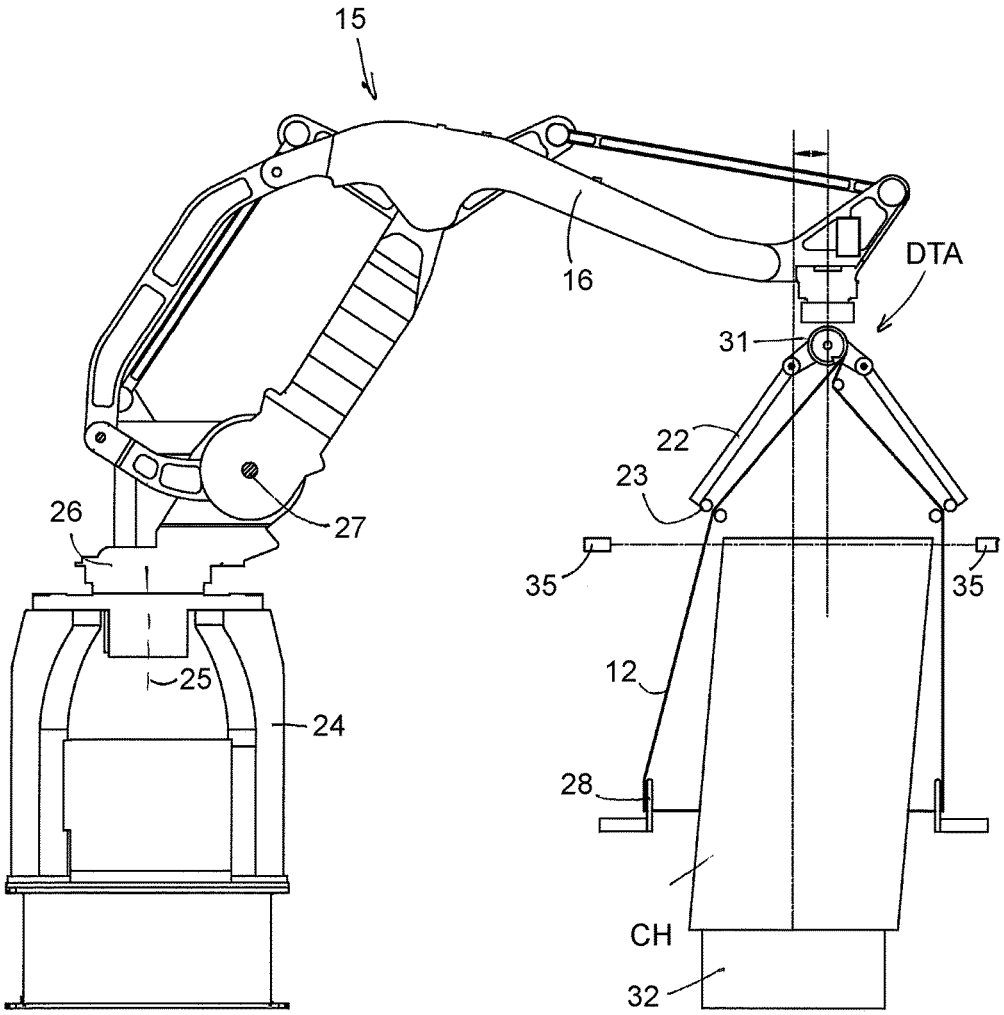
FIGS. 10 and 11 show elevational and side views of the transfer and accumulation device with a deformed load to be packaged.
Figure 11:
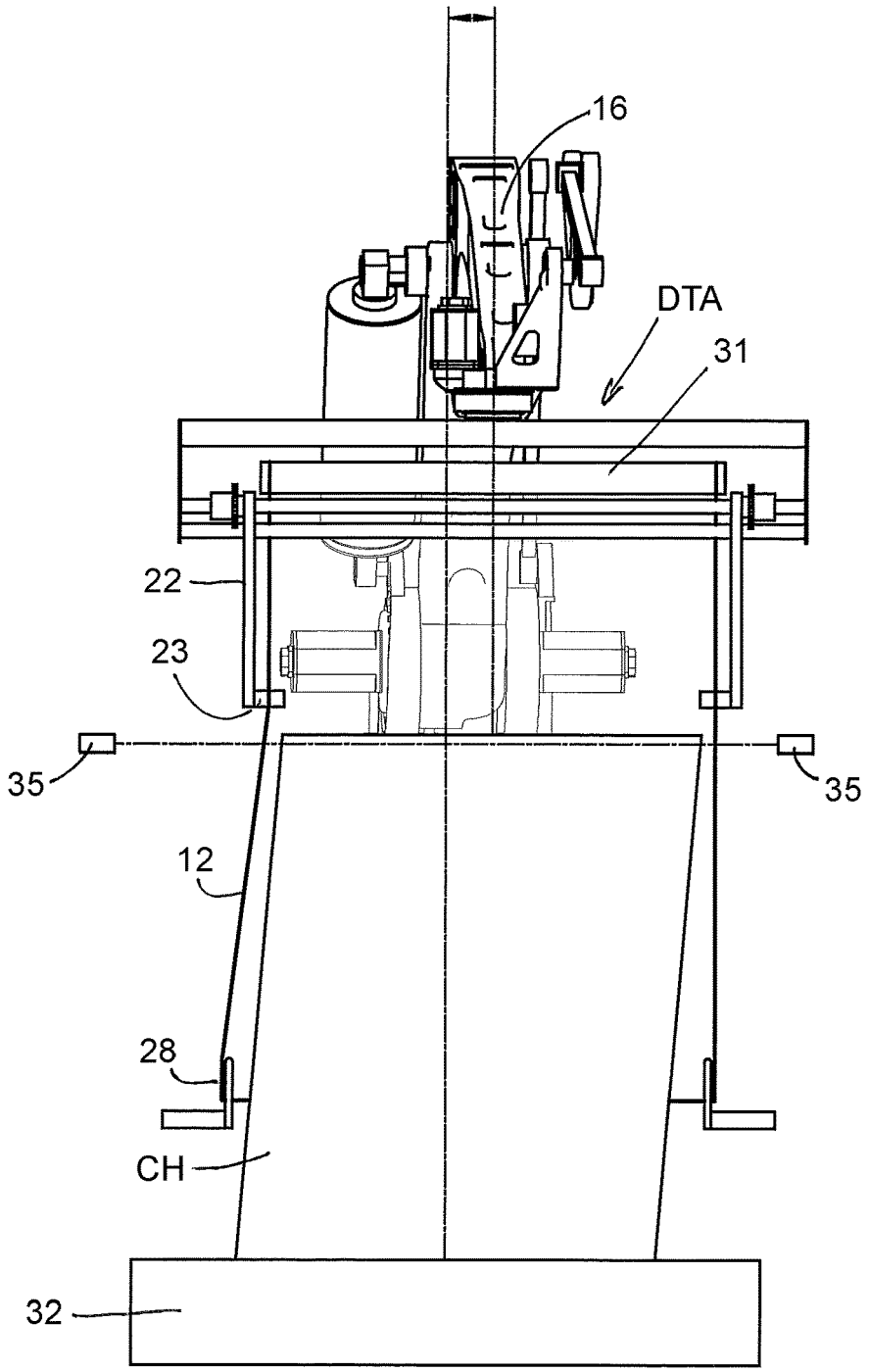

In FIG. 9, the longitudinal axis a2 of conveyor 32 forms an angle A different by 90° from feed axis a3 of the sleeve. During the control and/or measurement step of the position of the load CH to be packaged, sensors 35 then perform measurement of the angular position of the two axes a1 and a2 of the load CH to enable a rotation of the transfer and accumulation device DTA to be made with respect to a vertical axis by a suitable angle. This results in the possibility of positioning cover 12 in the best direction according to the load CH to be packaged, but also of adjusting to a feed axis of the load that is not perpendicular to the feed axis of the sleeve.

Fingers 10 and 11 show a load CH presenting a deformation that generally results from an offset of the top plane of the load with respect to the bottom plane. Control system 34 performs measurement of the position of the two (transverse and longitudinal) axes of the top plane of the load CH. The transfer and accumulation device DTA of the cover 12 can then be positioned according to these axes, and it enables the functional clearance to be balanced as best as possible during downward movement of the covering mechanism around the load. It also makes it possible to work with a sleeve having a parameter that is adjusted to that of the load to be packaged and therefore to reduce the quantity of cover used.

Figure 12:
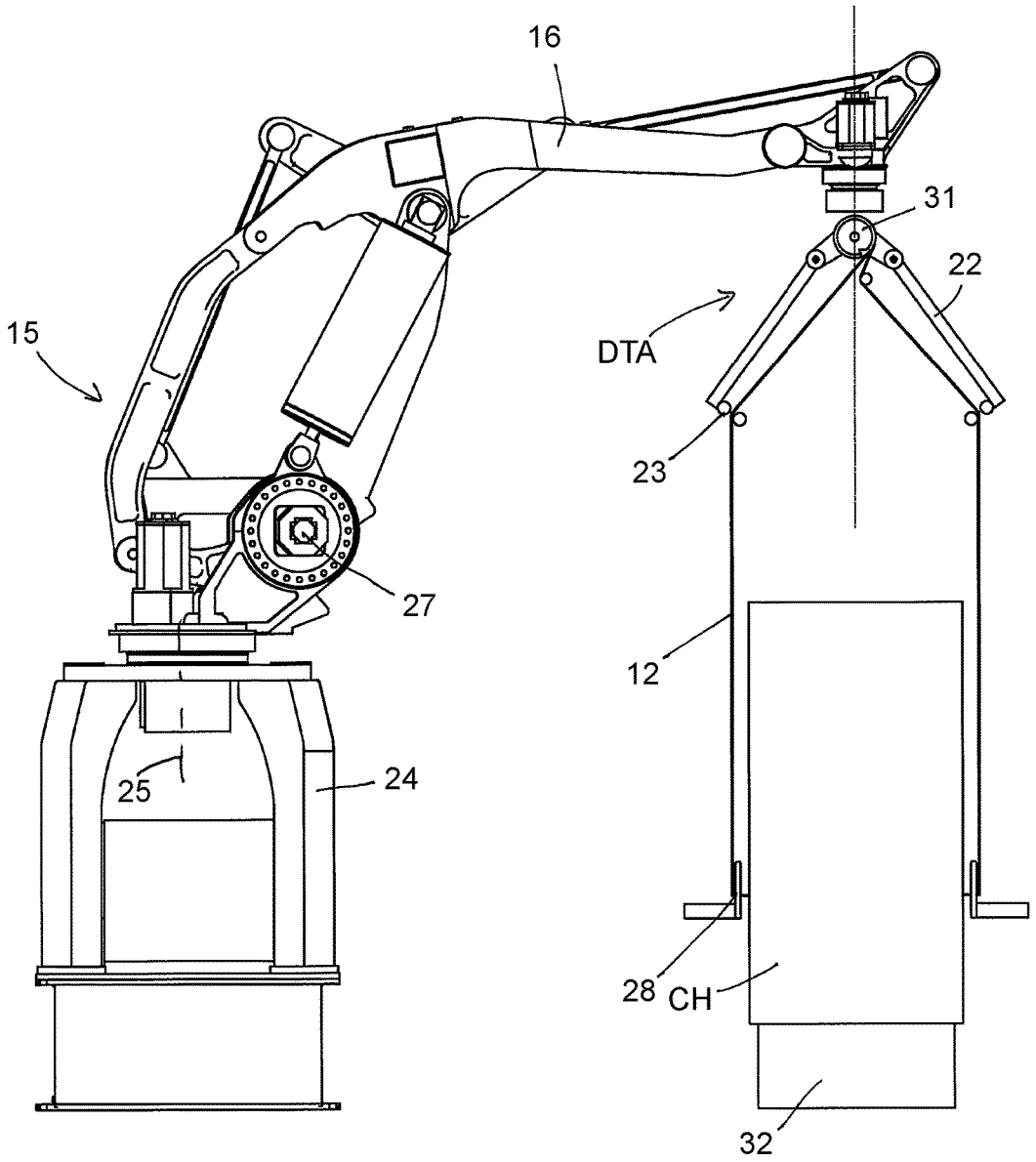
FIGS. 12 and 13 represent views of the transfer and accumulation device positioned by the arm of the robot at two height levels.
Figure 13:
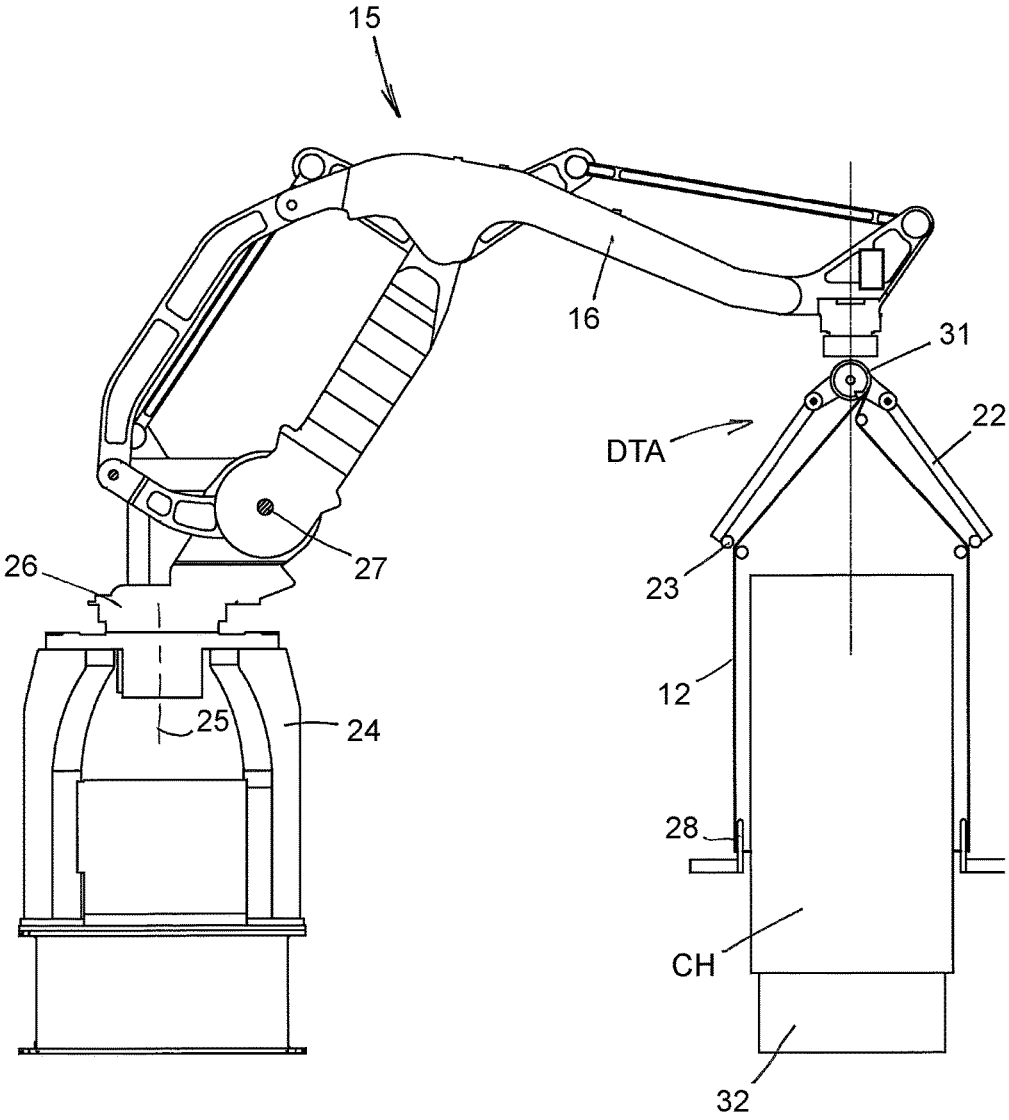

In FIGS. 12 and 13, the transfer and accumulation device DTA can be positioned by arm 16 of robot 15 at a defined height level and in a space dedicated to maintenance enabling a good accessibility for maintenance operations.

The invention claimed is:

1. A method for forming and depositing a packaging cover on a palletized load with a robot, said palletized load having a longitudinal mid-axis and a transverse mid-axis perpendicular to the longitudinal mid-axis, said cover being prepared from a sleeve made from flexible plastic material wound on at least one storage reel, the method comprising:

storing a predefined length of sleeve on a transfer and accumulation device with the sleeve constituting a cover closed at one end;

taking up an open end of the cover opposite to the closed end of the cover;

moving the palletized load to a covering area by means of a conveyor;

determining a first position of the transverse mid-axis of the palletized load with respect to a feed axis of the sleeve when the palletized load is stopped in the covering area;

determining a second position of the longitudinal mid-axis of the palletized load with respect to a longitudinal axis of the conveyor when the palletized load is stopped in the covering area;

adjusting longitudinal and lateral positions of the transfer and accumulation device according to said first and second positions of the palletized load so that the transfer and accumulation device is above the palletized load in the covering area;

adjusting longitudinal and lateral positions of take-up and spreading elements of a covering mechanism according to the position of the transfer and accumulation device; and moving the cover down and over the palletized load in the covering area, keeping the cover spread open via its four corners, wherein moving the cover from a preparation and forming station to the covering station includes positioning the cover over the palletized load based on the feed axis of the sleeve, the longitudinal mid-axis of the palletized load and the transverse mid-axis of the palletized load.

2. The method according to claim 1, comprising moving the palletized load by means of the conveyor during moving the cover down and wherein determination of the position of the load is performed by measurement of said first position of the transverse mid-axis during moving the cover down.

3. The method according to claim 1, comprising measuring angular shift between the longitudinal mid-axis of the palletized load and the longitudinal axis of the conveyor and wherein moving the cover from the preparation and forming station to the covering station includes positioning the cover over the palletized load based on the angular shift.

4. The method according to claim 1, wherein the palletized load has an offset of a top part of the palletized load with respect to the bottom part of the palletized load along the transverse mid-axis and wherein a covering mechanism adjusts fingers of a depositing arm to a transfer position of the transfer and accumulation device and the position of the load according to said functional clearance and said offset during downward movement of the cover.

5. The method according to claim 1, wherein the determining of said first and second positions of the load is made by sensors electronically connected to a control circuit of the robot.

6. A method for forming and depositing a packaging cover on a palletized load, the method comprising:

providing the palletized load having a longitudinal mid-axis and a transverse mid-axis perpendicular to the longitudinal mid-axis to a covering station;

providing a transfer and accumulation device configured to transfer a sleeve from a preparation and forming station comprising at least one storage reel to the covering station, the preparation and forming station defining at least a first feed axis of the sleeve, the transfer and accumulation device is mounted on an arm of a robot, the arm being mounted movable in rotation around a first rotation axis and the transfer and accumulation device is mounted moveable in rotation with respect to the arm around a second rotation axis;

storing a predefined length of sleeve on the transfer and accumulation device from the preparation and forming station, the sleeve constituting a cover closed at one end;

using an electronic control system to determine the longitudinal mid-axis of the palletized load and the transverse mid-axis of the load;

moving the cover from the preparation and forming station to the covering station by at least one rotational movement;

taking up an open end of the cover opposite to the closed end of the cover in the covering station; and moving the cover down and over the palletized load, keeping the cover spread open via its four corners, wherein the feed axis of the sleeve, the first rotation axis and the transverse mid-axis of the palletized load in the covering station are not aligned, and wherein moving the cover from the preparation and forming station to the covering station includes positioning the cover over the palletized load based on the feed axis of the sleeve, the longitudinal mid-axis of the palletized load determined by the electronic control system and the transverse mid-axis of the palletized load determined by the electronic control system.

7. The method according to claim 6, comprising providing a conveyor transporting the palletized load and measuring a first position of the transverse mid-axis with respect to the feed axis of the sleeve so as to determine longitudinal offset of the load and adjusting a longitudinal position of the transfer and accumulation device along a longitudinal axis of the conveyor with respect to the longitudinal offset of the load.

8. The method according to claim 7, wherein the covering station includes a covering mechanism comprising a depositing arms provided with fingers and wherein the method comprise adjusting the fingers of the depositing arm to the longitudinal position of the transfer and accumulation device and the position of the load.

9. The method according to claim 6, comprising providing a conveyor transporting the palletized load and measuring a second position of the longitudinal mid-axis with respect to a longitudinal axis of the conveyor so as to determine transversal offset of the load and adjusting a longitudinal position of the transfer and accumulation device along a longitudinal axis of the conveyor with respect to the transversal offset of the load.

10. The method according to claim 9, wherein the covering station includes a covering mechanism comprising a depositing arms provided with fingers and wherein the method comprise adjusting the fingers of the depositing arm to the position of the transfer and accumulation device and the position of the load.

11. The method according to claim 6, comprising providing a conveyor transporting the palletized load and measuring a first angular offset between the transverse mid-axis and the feed axis of the sleeve so as to determine an angular offset of the load on the conveyor and rotation the transfer and accumulation device around the second rotation axis so as to adjust angular offset of the transfer and accumulation device to the angular offset of the load.

12. The method according to claim 11, wherein the covering station includes a covering mechanism comprising a depositing arms provided with fingers and wherein the method comprises adjusting the fingers of the depositing arm to the transverse position of the transfer and accumulation device and the position of the load.

13. The method according to claim 6, comprising providing a conveyor transporting the palletized load and measuring a first bottom position of a bottom transverse mid-axis with respect to the feed axis of the sleeve and a first top position of a top transverse mid-axis with respect to the feed axis of the sleeve so as to determine longitudinal offset of the load and deformation of the palletized load along a direction passing through a bottom and a top of the palletized load and adjusting a longitudinal position of the transfer and accumulation device along a longitudinal axis of the conveyor with respect to the longitudinal offset of the load and the deformation of the palletized load.

14. The method according to claim 6, comprising providing a conveyor transporting the palletized load and measuring a second bottom position of the longitudinal mid-axis with respect to a longitudinal axis of the conveyor and a second top position of the longitudinal mid-axis with respect to a longitudinal axis of the conveyor so as to determine transversal offset of the load and deformation of the palletized load along a direction passing through a bottom and a top of the palletized load and adjusting a longitudinal position of the transfer and accumulation device along a longitudinal axis of the conveyor with respect to the transversal offset of the load.

15. The method according to claim 14, comprising measuring a second position of the longitudinal mid-axis with respect to a longitudinal axis of the conveyor so as to determine transversal offset of the load and adjusting a longitudinal position of the transfer and accumulation device along a longitudinal axis of the conveyor with respect to the transversal offset of the load.

16. The method according to claim 15, wherein the covering station includes a covering mechanism comprising a depositing arm provided with fingers and wherein the method comprises adjusting the fingers of the depositing arm to the transverse position of the transfer and accumulation device and the position of the load.

17. The method according to claim 14, comprising measuring a first angular offset between the transverse mid-axis and the feed axis of the sleeve so as to determine an angular offset of the load on the conveyor and rotating the transfer and accumulation device around the second rotation axis so as to adjust angular offset of the transfer and accumulation device to the angular offset of the load.

18. The method according to claim 14, wherein the covering station includes a covering mechanism comprising a depositing arm provided with fingers and wherein the method comprise adjusting the fingers of the depositing arm to the longitudinal position of the transfer and accumulation device and the position of the load.

19. A method for forming and depositing a packaging cover on a palletized load with a robot, said palletized load having a longitudinal mid-axis and a transverse mid-axis perpendicular to the longitudinal mid-axis, said cover being prepared from a sleeve made from flexible plastic material wound on at least one storage reel, the method comprising:

storing a predefined length of sleeve on a transfer and accumulation device with the sleeve constituting a cover closed at one end;

taking up an open end of the cover opposite to the closed end of the cover;

moving the palletized load to a covering area by means of a conveyor;

determining a first position of the transverse mid-axis of the load with respect to a feed axis of the sleeve when the palletized load is moving in the covering area;

determining a second position of the longitudinal mid-axis of the load with respect to a longitudinal axis of the conveyor when the palletized load is moving in the covering area;

adjusting longitudinal and lateral positions of the transfer and accumulation device according to said first and second positions of the palletized load during movement of the palletized load in the covering area so that the transfer and accumulation device is above the palletized load in the covering area;

adjusting longitudinal and lateral positions of take-up and spreading elements of a covering mechanism according to the position of the transfer and accumulation device; and moving the cover down and over the palletized load during movement of the palletized load in the covering area, keeping the cover spread open via its four corners.

20. A method for forming and depositing a packaging cover on a palletized load with a robot, said palletized load having a longitudinal mid-axis and a transverse mid-axis perpendicular to the longitudinal mid-axis, said cover being prepared from a sleeve made from flexible plastic material wound on at least one storage reel, the method comprising:

storing a predefined length of sleeve on a transfer and accumulation device with the sleeve constituting a cover closed at one end;

taking up an open end of the cover opposite to the closed end of the cover;

moving the palletized load to a covering area by means of a conveyor;

using an electronic control system to determine a first position of the transverse mid-axis of the palletized load with respect to a feed axis of the sleeve when the palletized load is stopped in the covering area;

using an electronic control system to determine a second position of the longitudinal mid-axis of the palletized load with respect to a longitudinal axis of the conveyor when the palletized load is stopped in the covering area;

adjusting longitudinal and lateral positions of the transfer and accumulation device based on the feed axis of the sleeve, the first position determined by the electronic control system, and the second position determined by the electronic control system so that the transfer and accumulation device is above the palletized load in the covering area and balances functional clearance of a covering mechanism around the palletized load; and moving the cover down and over the palletized load in the covering area, keeping the cover spread open via its four corners.

* * * * *